US005791534A

United States Patent [19]

Davis et al.

[11] Patent Number: 5,791,534

[45] Date of Patent: Aug. 11, 1998

[54] PAINTING CADDY

[76] Inventors: Carolyn Davis; Karen Moerer, both of 1450 NW. 64th Terr., Kansas City, Mo. 64118

[21] Appl. No.: 911,931

[22] Filed: Aug. 15, 1997

[51] Int. Cl.[6] ..... A45F 5/00

[52] U.S. Cl. ..... 224/148.7; 224/679; 220/697; 220/736; 206/362

[58] Field of Search ..... 224/148.7, 148.2, 224/679; 206/1.7, 1.8, 1.9, 209, 361, 362, 15.3; 15/257.05, 257.06; 220/736, 697; 141/86

[56] References Cited

U.S. PATENT DOCUMENTS

| | | | |
|---|---|---|---|
| 1,109,161 | 9/1914 | Chindgren | 224/148.7 |
| 2,985,349 | 5/1961 | McGuire | 224/5 |
| 3,493,152 | 2/1970 | Ort | 224/5 |
| 4,363,433 | 12/1982 | Jacques | 224/679 |
| 5,163,591 | 11/1992 | Leiserson et al. | 224/148 |
| 5,489,051 | 2/1996 | Robinson | 224/148 |
| 5,540,363 | 7/1996 | Wilson | 224/679 |

*Primary Examiner*—Linda J. Sholl
*Attorney, Agent, or Firm*—Joseph N. Breaux

[57] ABSTRACT

A painting caddy including a housing; a strap secured to the housing in a manner to allow the housing to be secured therewith to the waist of a user; a paint reservoir vessel in connection with the housing; and at least one paint brush holder having a brush insertion vessel in connection with the housing wherein the paint reservoir vessel and the brush insertion vessel are in fluid connection through a one-way valve that allows fluid flow from the brush insertion vessel to the paint reservoir vessel and blocks fluid flow in the opposite direction.

16 Claims, 3 Drawing Sheets

PAINTING CADDY

TECHNICAL FIELD

The present invention relates to painting aids and more particularly to a painting caddy having a housing that is securable to a user with an elastic strap; a paint reservoir vessel in connection with the housing; and at least one paint brush holder having a brush insertion vessel in connection with the housing wherein the paint reservoir vessel and the brush insertion vessel are in fluid connection through a one-way valve that allows fluid flow from the brush insertion vessel to the paint reservoir vessel and block fluid flow in the opposite direction.

BACKGROUND OF THE INVENTION

Painting can be a messy task that is hard on the painters back. It would be a benefit, therefore, to have a painting caddy that allowed a user to carry a quantity of paint at about waist level to resupply a paintbrush as required. In addition, because it is often difficult to find a place to hold a wet paintbrush during breaks or when a different sized brush is required it would be a further benefit if the painting caddy included a brush holder for holding a wet paintbrush. Because paint can flow from the paintbrush while held by the holder it would be a benefit if the brush holder included a mechanism for returning this paint to the paint reservoir of the paint caddy. Also, because a painter may require more than one brush when painting, it would be further desirable to have a painting caddy that included multiple brush holders.

SUMMARY OF THE INVENTION

It is thus an object of the invention to provide a painting caddy that includes a strap and a paint reservoir to allow a user to carry a quantity of paint at about waist level.

It is a further object of the invention to provide a painting caddy that includes a brush holder for holding a wet paintbrush.

It is a still further object of the invention to provide a painting caddy that includes a brush holder for holding a wet paintbrush that includes a mechanism for returning paint drippings from the wet paintbrush to the paint reservoir of the paint caddy.

It is a still further object of the invention to provide a painting caddy that includes a housing that is securable to a user with an elastic strap; a paint reservoir vessel in connection with the housing; and at least one paint brush holder having a brush insertion vessel in connection with the housing wherein the paint reservoir vessel and the brush insertion vessel are in fluid connection through a one-way valve that allows fluid flow from the brush insertion vessel to the paint reservoir vessel and blocks fluid flow in the opposite direction.

It is a still further object of the invention to provide a painting caddy that accomplishes some or all of the above objects in combination.

Accordingly, a painting caddy is provided. The painting caddy includes a housing; a strap secured to the housing in a manner to allow the housing to be secured therewith to the waist of a user; a paint reservoir vessel in connection with the housing; and at least one paint brush holder having a brush insertion vessel in connection with the housing wherein the paint reservoir vessel and the brush insertion vessel are in fluid connection through a one-way valve that allows fluid flow from the brush insertion vessel to the paint reservoir vessel and blocks fluid flow in the opposite direction. In a preferred embodiment the strap is elastic.

BRIEF DESCRIPTION OF DRAWINGS

For a further understanding of the nature and objects of the present invention, reference should be made to the following detailed description, taken in conjunction with the accompanying drawings, in which like elements are given the same or analogous reference number and wherein.

DESCRIPTION OF THE EXEMPLARY EMBODIMENT

Figure 1:
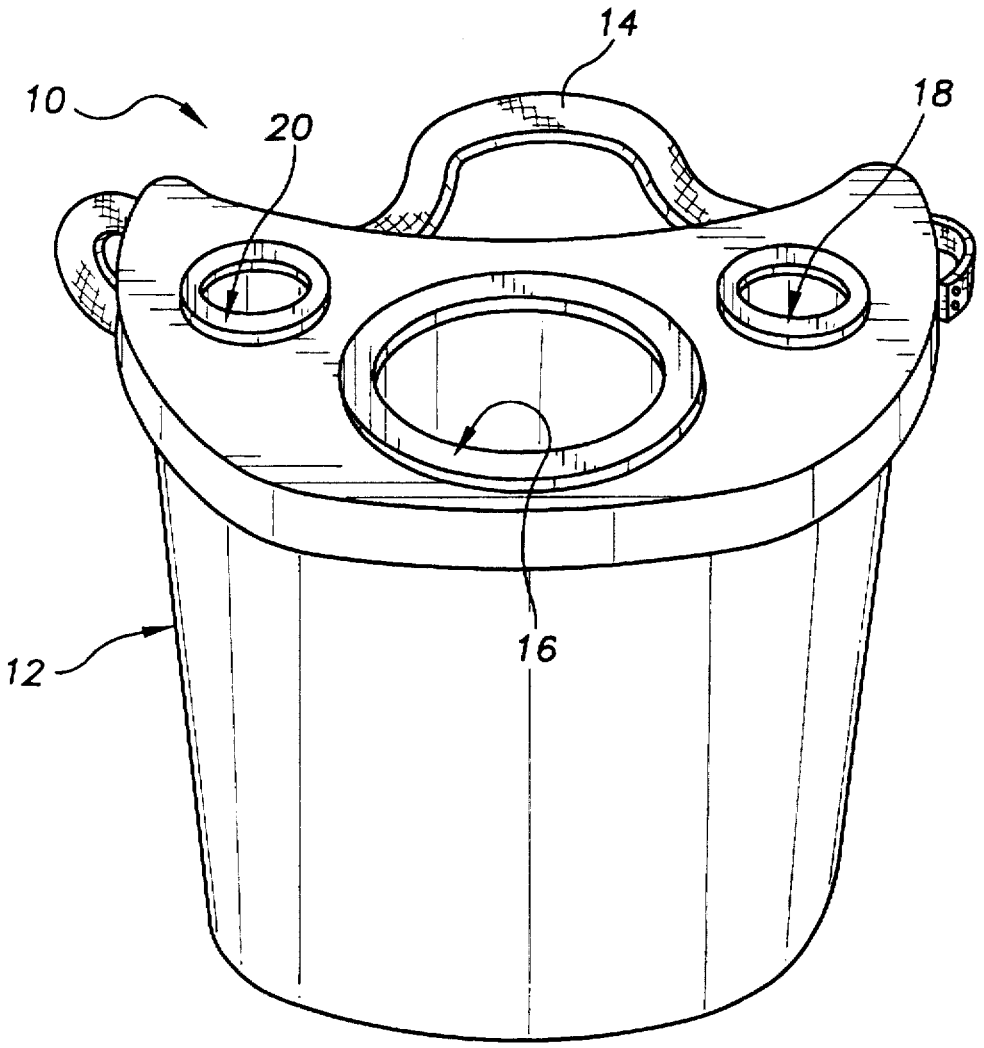
FIG. 1 is a perspective view of an exemplary embodiment of the painting caddy of the present invention showing the housing, the top cover, the central paint reservoir vessel, the left paintbrush holder, the right paintbrush holder and the elastic waistband.

FIG. 1 shows an exemplary embodiment of the paint caddy of the present invention generally designated by the numeral 10. Paint caddy 10 includes a two-part housing generally designated by the numeral 12; an elastic strap 14; a paint reservoir vessel, generally designated by the numeral 16; a left paint brush holder, generally designated by the numeral 18; and a right paint brush holder generally designated by the numeral 20. Two-part housing 12 includes a molded plastic lower housing member 22 and a molded plastic upper housing member 24.

Figure 2:
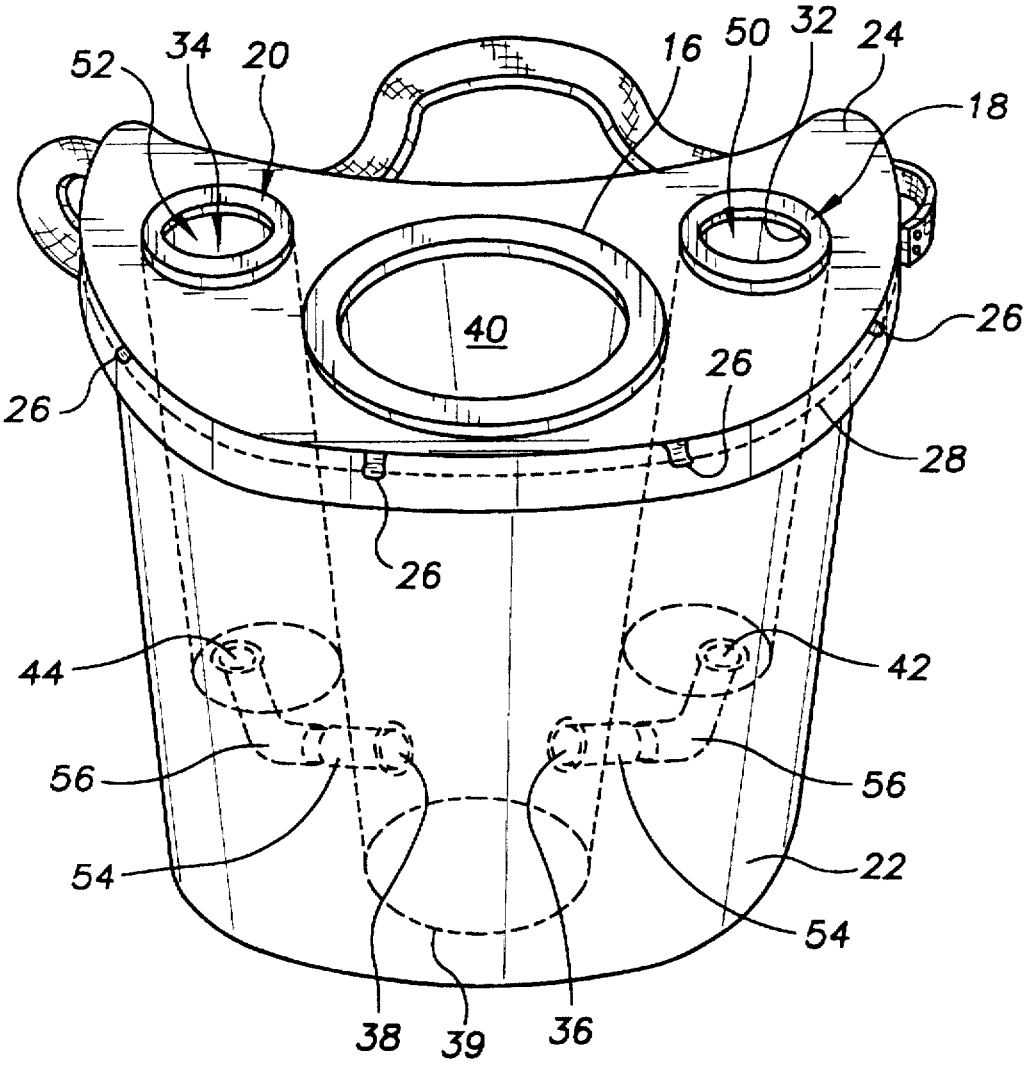
FIG. 2 is a perspective view of the painting caddy of FIG. 1 showing the interconnections between the left and right brush insertion vessels of the left and right paintbrush holders and the paint reservoir vessel, each interconnection including a one-way flapper valve that allows passage of fluids from the brush insertion vessel to the paint reservoir vessel but prevents flow in the opposite direction.

With reference to FIG. 2, upper housing member 24 has a number of snap connectors 26 that engage and hold the rim 28 of lower housing member 22. In this embodiment, upper housing member 24 has paint reservoir vessel 16, left paint brush holder 18, and right paint brush holder 20 integrally formed therewith. Left and right paintbrush holders 18,20 each include a brush insertion vessels 32,34, respectively.

Figure 3:
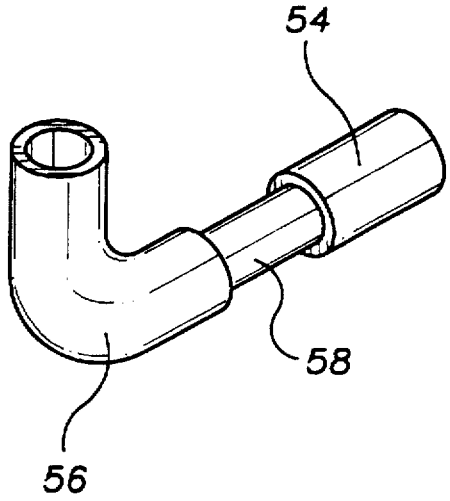
FIG. 3 is a perspective view of one of the two identical one-way flapper valves of FIG. 2 showing the one-way flapper valve installed between a paint reservoir fill tube and a brush insertion vessel drain tube.
Figure 4:
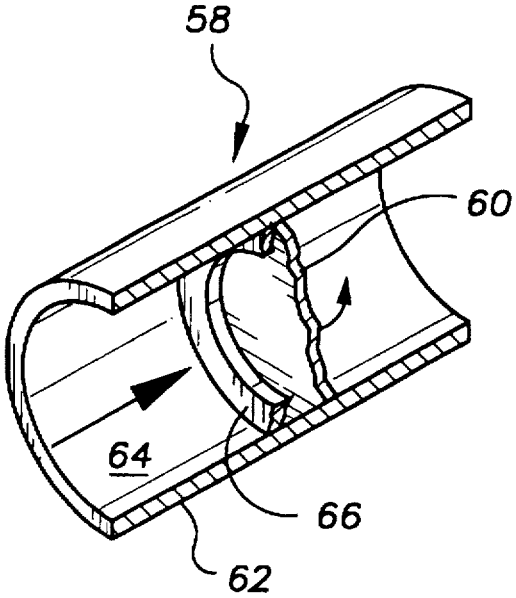
FIG. 4 is a cross section view of an exemplary one-way flapper valve showing the flexible flapper seal, the washer shaped seal seat, and the tubular valve housing.

Paint reservoir vessel 16 has a left fill port 36 and a right fill port 38 in connection with a paint holding cavity 40 about one inch from a bottom surface 39 of paint reservoir vessel 16. Left and right brush insertion vessels 32,34 each have a drain port 42,44, respectively, formed through a bottom surface 46,48 and in connection with a left or right brush holding cavity 50,52. A flexible tubing section 54 extends from each fill port 36,38. Another flexible tubing section 56 having a right angled bend extends from each drain port 42,44. With reference to FIG. 3, each tubing section 56 is connected to a tubing section 54 by a one-way flapper valve 58. Referring now to FIG. 4, each one-way flapper valve 58 includes a flexible rubber flapper seal 60, and a molded plastic valve housing 62 having a flow passageway 64 and an integrally formed washer shaped seal seat 66. Paint passing in a first direction flexes flapper seal 60 away from seal seat 66 allowing the paint flow through one-way flapper valve 58. Paint attempting to flow in the opposite direction forces flapper seal 60 into sealing contact with seal seat 66 preventing the flow of paint through one-way flapper valve 58.

With general reference to FIGS. 1–4, painting caddy 10 is attached to the user by positioning strap 14 about the user's waist. Once housing 12 is in place at waist level, paint holding cavity 40 is filled with a desired amount of paint. Paint brushes can be stored in a brush insertion vessel 32,34 of left and right brush holders 18,20 when dry and when wet. If a wet paintbrush is placed into a brush insertion vessel 32,34, paint dripping from the paintbrush is provided a pathway into paint holding cavity 40 through a one-way valve 58. Paint is prevented from flowing from paint holding cavity 40 into either brush insertion vessel 32,34 by the action of one-way valves 58.

It can be seen from the preceding description that a painting caddy has been provided that includes a strap and a paint reservoir; that includes a brush holder for holding a wet paintbrush; that includes a brush holder for holding a wet paintbrush that includes a mechanism for returning paint drippings from the wet paintbrush to the paint reservoir of the paint caddy; and that includes a housing that is securable to a user with an elastic strap, a paint reservoir vessel in connection with the housing, and at least one paint brush holder having a brush insertion vessel in connection with the housing wherein the paint reservoir vessel and the brush insertion vessel are in fluid connection through a one-way valve that allows fluid flow from the brush insertion vessel to the paint reservoir vessel and blocks fluid flow in the opposite direction.

It is noted that the embodiment of the painting caddy described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A painting caddy comprising:

a housing;

a strap secured to said housing in a manner to allow said housing to be secured with said strap to the waist of a user;

a paint reservoir vessel in connection with said housing; and a first paintbrush holder, said first paintbrush holder having a brush insertion vessel in connection with said housing, said paint reservoir vessel and said brush insertion vessel being in fluid connection through a one-way valve that allows fluid flow from said brush insertion vessel to said paint reservoir vessel and blocks fluid flow in the opposite direction.

2. The painting caddy of claim 1, wherein:

said strap is elastic.

3. The painting caddy of claim 1, wherein:

said paint reservoir vessel and said brush insertion vessel are integrally formed with said housing.

4. The painting caddy of claim 1 wherein:

said paint reservoir vessel includes a fill port in connection with a paint holding cavity formed within said paint reservoir vessel at a location above a reservoir vessel bottom surface of said paint reservoir vessel;

said brush insertion vessel includes a drain port formed through an insertion vessel bottom surface and in connection with a brush holding cavity; and said painting caddy further includes:

a first tubing section that extends from said fill port;

a second tubing section having a right angled bend formed therein that extends from said drain port; and further wherein:

said one-way valve is connected between said first tubing section and said second tubing section.

5. The painting caddy of claim 4 wherein:

said one-way valve is a flapper valve including a valve housing having a flow passageway formed therethrough, a seal seat positioned within said flow passageway, and a flexible flapper seal positioned in relationship to said seal seat in a manner such that paint passing in a first direction through said flow passageway flexes said flapper seal away from said seal seat and paint attempting to flow in the opposite direction forces said flapper seal into sealing contact with said seal seat.

6. The painting caddy of claim 5 wherein:

said seal seat is washer shaped and integrally formed with said valve housing.

7. The painting caddy of claim 2, wherein:

said paint reservoir vessel and said brush insertion vessel are integrally formed with said housing.

8. The painting caddy of claim 2 wherein:

said paint reservoir vessel includes a fill port in connection with a paint holding cavity formed within said paint reservoir vessel at a location above a reservoir vessel bottom surface of said paint reservoir vessel;

said brush insertion vessel includes a drain port formed through an insertion vessel bottom surface and in connection with a brush holding cavity; and said painting caddy further includes:

a first tubing section that extends from said fill port;

a second tubing section having a right angled bend formed therein that extends from said drain port; and further wherein:

said one-way valve is connected between said first tubing section and said second tubing section.

9. The painting caddy of claim 8 wherein:

said one-way valve is a flapper valve including a valve housing having a flow passageway formed therethrough, a seal seat positioned within said flow passageway, and a flexible flapper seal positioned in relationship to said seal seat in a manner such that paint passing in a first direction through said flow passageway flexes said flapper seal away from said seal seat and paint attempting to flow in the opposite direction forces said flapper seal into sealing contact with said seal seat.

10. The painting caddy of claim 9 wherein:

said seal seat is washer shaped and integrally formed with said valve housing.

11. The painting caddy of claim 7 wherein:

said paint reservoir vessel includes a fill port in connection with a paint holding cavity formed within said paint reservoir vessel at a location above a reservoir vessel bottom surface of said paint reservoir vessel;

said brush insertion vessel includes a drain port formed through an insertion vessel bottom surface and in connection with a brush holding cavity; and said painting caddy further includes:

a first tubing section that extends from said fill port;

a second tubing section having a right angled bend formed therein that extends from said drain port; and further wherein:

said one-way valve is connected between said first tubing section and said second tubing section.

12. The painting caddy of claim 11 wherein:

said one-way valve is a flapper valve including a valve housing having a flow passageway formed therethrough, a seal seat positioned within said flow passageway, and a flexible flapper seal positioned in relationship to said seal seat in a manner such that paint passing in a first direction through said flow passageway flexes said flapper seal away from said seal seat and paint attempting to flow in the opposite direction forces said flapper seal into sealing contact with said seal seat.

13. The painting caddy of claim 12 wherein:

said seal seat is washer shaped and integrally formed with said valve housing.

14. The painting caddy of claim 3 wherein:

said paint reservoir vessel includes a fill port in connection with a paint holding cavity formed within said paint reservoir vessel at a location above a reservoir vessel bottom surface of said paint reservoir vessel;

said brush insertion vessel includes a drain port formed through an insertion vessel bottom surface and in connection with a brush holding cavity; and said painting caddy further includes:

a first tubing section that extends from said fill port;

a second tubing section having a right angled bend formed therein that extends from said drain port; and further wherein:

said one-way valve is connected between said first tubing section and said second tubing section.

15. The painting caddy of claim 14 wherein:

said one-way valve is a flapper valve including a valve housing having a flow passageway formed therethrough, a seal seat positioned within said flow passageway, and a flexible flapper seal positioned in relationship to said seal seat in a manner such that paint passing in a first direction through said flow passageway flexes said flapper seal away from said seal seat and paint attempting to flow in the opposite direction forces said flapper seal into sealing contact with said seal seat.

16. The painting caddy of claim 15 wherein:

said seal seat is washer shaped and integrally formed with said valve housing.

* * * * *